US005953779A

United States Patent [19]

Schwartz

[11] Patent Number: 5,953,779

[45] Date of Patent: Sep. 21, 1999

[54] MATTRESS ASSEMBLY

[76] Inventor: Jack Schwartz, 472 Spadina Road., Suite 1, Toronto, Ontario, Canada, M5P 2W7

[21] Appl. No.: 08/655,215

[22] Filed: Jun. 5, 1996

[51] Int. Cl.[6] ..... A47C 27/15

[52] U.S. Cl. ..... 5/722; 5/723; 5/692; 5/740; 5/727

[58] Field of Search ..... 5/692, 697, 722, 5/723, 727, 728, 729, 730, 737, 739, 740, 494, 498

[56] References Cited

U.S. PATENT DOCUMENTS

| | | | |
|---|---|---|---|
| 1,784,294 | 12/1930 | Kriege | 5/723 |
| 2,154,910 | 4/1939 | Magaril | 5/722 |
| 2,706,820 | 4/1955 | Mullring | 5/498 |
| 2,826,766 | 3/1958 | Stoner | 5/498 |
| 2,879,523 | 3/1959 | Klassen et al. | 5/723 |
| 2,896,226 | 7/1959 | Swicegood et al. | 5/498 |
| 3,625,526 | 12/1971 | Viel | 5/722 |
| 5,325,554 | 7/1994 | Lewis | 5/692 X |
| 5,327,595 | 7/1994 | Allen | 5/692 |

FOREIGN PATENT DOCUMENTS

| | | | |
|---|---|---|---|
| 1258752 | 12/1971 | United Kingdom | 5/722 |

*Primary Examiner*—Michael F. Trettel
*Attorney, Agent, or Firm*—Darby & Darby

[57] ABSTRACT

The foam mattress assembly has a stack of foam mattress elements with one of their peripheral edges joined together such that the stack of foam mattress elements remains in a vertical stack. The containment system which keeps side-by-side mattress together consists of a head and foot containment block extending across the top and bottom respectively of a pair of adjacent mattresses. The head and foot containment blocks make up a portion of the sleeping surface and are of a sufficient size and strength to prevent lateral outward movement of the pair of adjacent foam mattresses. Bedding for the mattress assembly is secured around the outer edge of the mattress or around the outer edge of the containment system by using a retainer rope tensioned around the mattress to hold the bedding into a groove.

24 Claims, 4 Drawing Sheets

MATTRESS ASSEMBLY

FIELD OF THE INVENTION

The present invention relates to improvements in a mattress assembly. More specifically, the resent invention relates to an improved mattress assembly having improved interconnection of foam mattress elements in a multilayer stack to contain the stack of foam mattress elements arranged one on top of the other in vertical order, an improved means to contain a pair of adjacent foam mattresses on a common base to prevent lateral outward movement of the foam mattresses on the base, and an improved means for securing bedding around a mattress body.

BACKGROUND OF THE INVENTION

An adjustable mattress system which incorporates a containment means is described in detail in U.S. Pat. No. 5,513,402 granted May 7, 1996 to the applicant of this application, Jack Schwartz. The specification of U.S. Pat. No. 5,513,402 is incorporated herewith by reference. A containment means in the present context of a multilayer mattress system is the system used to keep a vertical stack of foam mattress elements aligned in the vertical stack, or a pair of adjacent mattresses (including a pair of stacks of foam mattress elements) together at their side-by-side median or meeting line. In U.S. Pat. No. 5,513,402, the containment means comprises, in one embodiment, a foam peripheral edge member called a cradle. In another embodiment, a fitted sheet is used, and in yet another embodiment, straps are used to interconnect head and foot ends of individual foam mattress elements in the side-by-side stacks.

It has been found that any failure in the containment means is most likely to occur when a person rests or shifts his weight in the middle of a mattress, particularly at the median line dividing two sets of adjacent stacks of foam mattress elements. While the containment means disclosed in U.S. Pat. No. 5,513,402 succeed in substantially keeping the stacks of foam mattress elements together, any small separation of the side-by-side mattresses at the median line is noticeable and is to be avoided. As can be understood, the use of a fitted sheet or the use of straps at the head and foot of the median line will contain the mattress assembly, yet it has been found that the tendency to separate at the median line in the middle of the mattress where the greatest weight and pressure is placed remains. Therefore, a containment means which is highly resistant to separation at the median line or as a result of shifting of weight in the middle of the mattress is very desirable. One solution to contain side-by-side mattresses is disclosed in French Patent Publication 2 590 142 (May 1987) in which the upper surface of the side-by-side foam mattresses are attached together by a strip of fabric so that separation along the median line is prevented. It has been found that this type of solution reduces independence between the side-by-side mattresses which is undesirable.

Also disclosed in U.S. Pat. No. 5,513,402 is a containment means which includes a foam peripheral edge member including slits in which a mattress cover and bottom sheet can be tucked in. It has been found that such a system for securing bedding can result in the bedding becoming loose under certain more extreme conditions.

SUMMARY OF THE INVENTION

According to a first aspect of the present invention, containment for at least one stack of foam mattress elements is provided by joining at least one of the peripheral edges of each one of the foam mattress elements together such that the stack of foam mattress elements remains in a vertical stack.

According to this first aspect of the present invention, there is provided a foam mattress assembly comprising at least one stack of foam mattress elements arranged one on top of the other and having peripheral edges, and interface fastening means for fastening at least one of the peripheral edges of each one of the mattress elements together such that the stack of foam mattress elements remains in a vertical stack. The interface fastening means may comprise strips of hook and loop fasteners (Velcro™) fastening together a lengthwise lateral edge of the mattress elements, or a lengthwise edge horizontal border surface of the mattress elements.

According to a second aspect of the present invention, the containment means consists of a head and foot containment block extending across the top and bottom respectively of a pair of adjacent foam mattresses. The head and foot containment blocks make up a portion of the sleeping surface and are of a sufficient size and strength to prevent lateral outward movement of the pair of adjacent foam mattresses.

According to the second aspect of the invention, there is provided a mattress assembly comprising a base, a pair of adjacent foam mattresses on the base, a head containment block fastened to the base and extending across a top of the pair of adjacent foam mattresses, and a foot containment block fastened to the base and extending across a bottom of the pair of adjacent foam mattresses, the containment blocks including means for preventing a lateral outward movement of the mattresses on the base. The means for preventing the lateral outward movement may comprise an interlocking portion, such as a tail portion of the adjacent foam mattresses, which fit into recesses in the head and foot containment blocks.

According to a third aspect of the present invention, bedding is secured around the outer edge of the mattress or around the outer edge of the containment means by using a retainer rope or the like tensioned around the mattress to hold the bedding into a recessed groove or slot extending at least partially around the mattress.

According to the third aspect of the present invention, there is provided a mattress assembly comprising a mattress body providing a sleeping zone, a peripheral bedding anchor member adapted to substantially surround an outer edge of the mattress body and including at least one peripheral bedding receiving recess means, and a retainer means for securing bedding into the recess means.

BRIEF DESCRIPTION OF THE DRAWINGS

The invention will be better understood by way of the following detailed description of a preferred embodiment with reference to the appended drawings in which.

DETAILED DESCRIPTION OF THE PREFERRED EMBODIMENT

Figure 1:
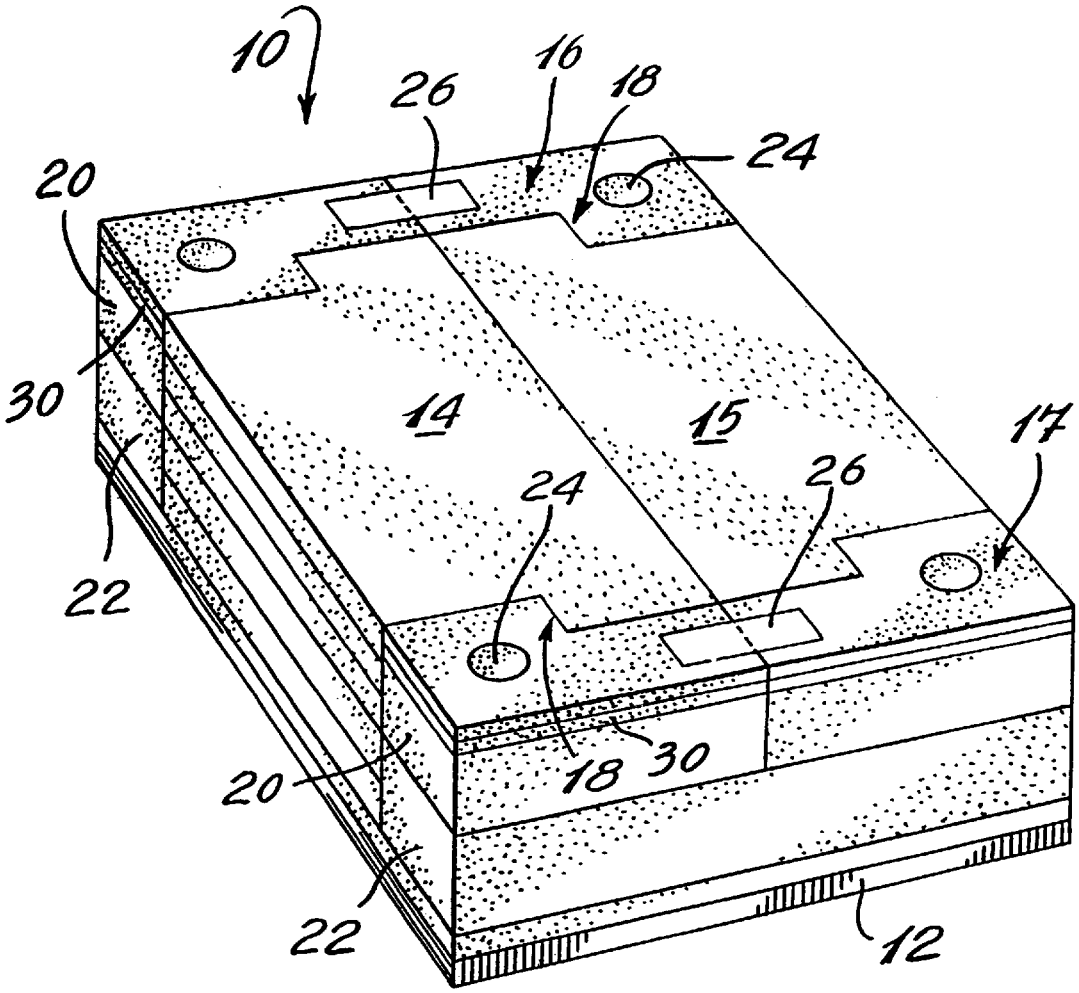
FIG. 1 is a perspective view from above of the foam mattress assembly according to the preferred embodiment.

As shown in FIG. 1, the mattress assembly 10 is provided on a base 12 and includes a pair of adjacent stacks 14 and 15 of foam mattresses having a lengthwise side making contact with one another. The foam mattresses are shaped with an interlocking protrusion 18 to prevent lateral outward movement when it relocks with a head containment block 16 and a foot containment block 17. The containment blocks 16 and 17 are made of foam. The containment blocks 16 and 17 in the preferred embodiment facilitate access to the stack of foam mattress elements for lifting them and rearranging them in a chosen order within the stack by making an upper part 20 of the blocks 16 and 17 separate from a bottom portion 22 and split at a middle with an upper fabric hinge 26 interconnecting the two upper portions 20. By lifting the upper portion 20, better access can be had to the upper foam mattress elements in the stacks 14 and 15. The upper portions 20 are connected to the lower portions 22 by foam pegs 24 which plug into a receiving bore hole such that the upper portion 20 can be lifted from the lower portion 22 with the result that the pegs 24 are pulled out of the complementary bore holes. In the preferred embodiment, the peg 24 is made solid with the upper portion 22 so that as the upper portion 20 is lifted up and out of the way, the peg 24 does not interfere with the removal and insertion of foam mattress elements in the stack. The blocks 16 and 17 are of course themselves secured to the base 12 by means of Velcro or the like.

Figure 6:
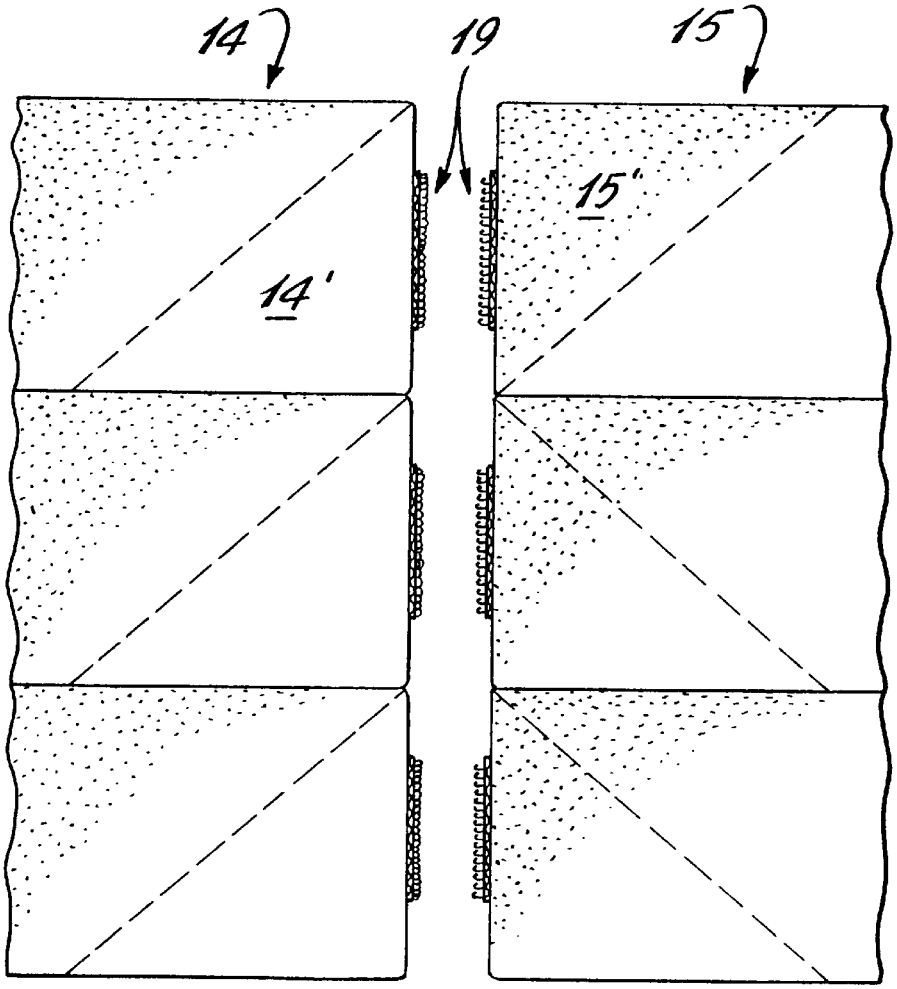
FIG. 6 is a partial sectional view of an alternative embodiment in which lateral side surface fastening means are provided to connect members of the adjacent side-by-side stacks of foam mattress elements together at a point midway between the head and the foot to prevent outward lateral movement of the adjacent stacks of foam mattress elements with respect to one another.

In the preferred embodiment, the dimensions of the blocks 16 and 17 are chosen so as to provide, along with the means 18, a relatively solid foam assembly which greatly resists separation at the median line between the stack of foam mattress elements 14 and 15. In an alternative embodiment illustrated in FIG. 6, a fastener such as a hook and eye or patches of Velcro as shown at 19, are provided between the lateral side surfaces of the mattress elements in stacks 14 and 15 at a middle portion to prevent the middle of the stacks from separating. As can also be seen from FIG. 6, the mattress elements include lengthwise edge modulator panels 14' and 15' so that the firmness of the foam mattress elements at the median line is at least partially equalized no matter what the firmness of the foam mattress elements on their main sleeping portion. The provision of Velcro at the abutting lengthwise edges of the stacks 14 and 15 creates, however, some dependence between the adjacent stacks. While in some circumstances this may be desirable, in the preferred embodiment, it is preferred to interconnect the top and bottom horizontal border surfaces of the mattress elements in the stacks 14 and 15 to one another as is illustrated in FIG. 4 using Velcro patches 50 and 52 in such a way that separation at the median line of the stacks 14 and 15 is hindered while independent vertical compression or movement between the mattresses 14 and 15 is maintained.

Figure 2:
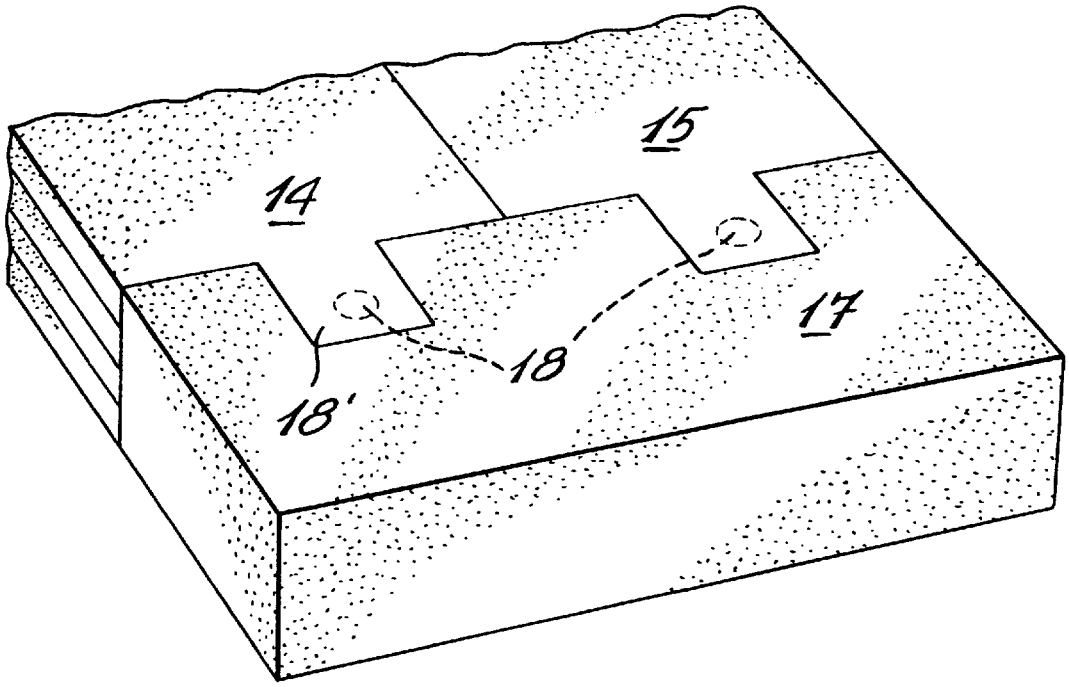
FIG. 2 is a partial view similar to FIG. 1 in which a variant embodiment is illustrated.

In the variant embodiment illustrated in FIG. 2, the interlocking portion 18 between the stacks 14 and 15 and the head and foot containment blocks 16 and 17 is provided as a tail-like tab portion 18' which fits into a notch in the containment block. In this variant embodiment, and as shown in FIG. 2, patches of Velcro 28 are provided at the interfaces between the mattress elements so as so improve the ability of the tail portions 18' to act as a unitary block of foam for keeping the side-by-side mattresses 14 and 15 contained together. The Velcro patches 28 also maintain the tails 18' fastened down to the base 12 when the blocks 16 or 17 are being lifted and removed.

Figure 4:
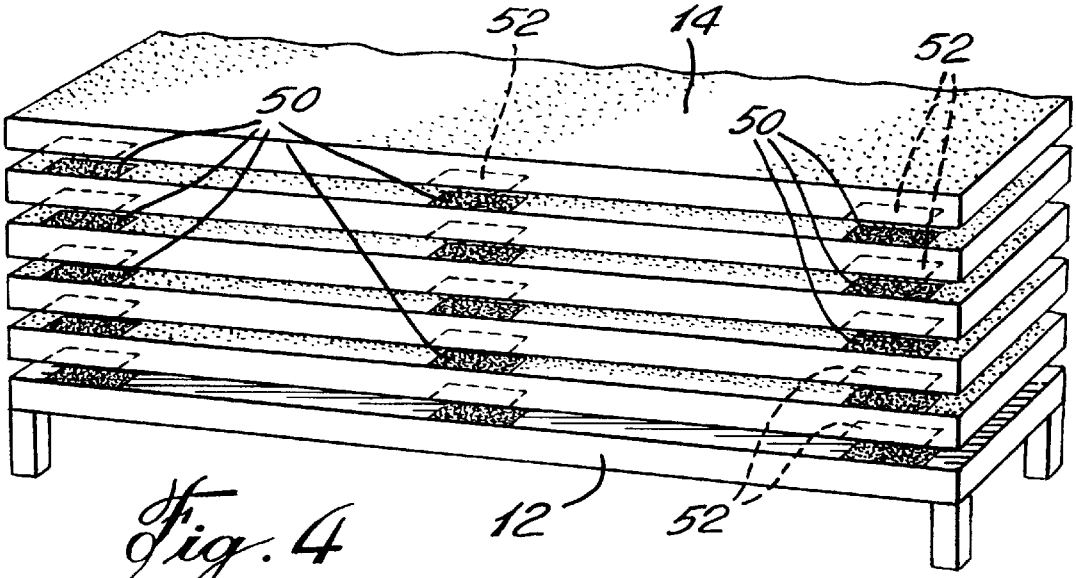
FIG. 4 is a side perspective view of a single stack of foam mattress elements including interface fastening means.

In the embodiment illustrated in FIG. 4, there is shown interface fastening means 50 and 52 which consist of Velcro patches provided in vertical alignment with one another so as to attach an edge border portion along one side of the stack 14 together and to attach the bottom mat to base 12. Since the foam mattress elements 14 in the preferred embodiment are all provided with separation means, the mats in the stack 14 are able to compress and flex separately with the result that there is movement at the interfaces between the mattress elements. However, the lengthwise edge at which the interface fastening means are provided remains in vertical alignment. In the embodiment of FIG. 4, such fastening means can advantageously be used as a containment means to maintain a pair of adjacent side-by-side stacks together on a common base.

Figure 5:
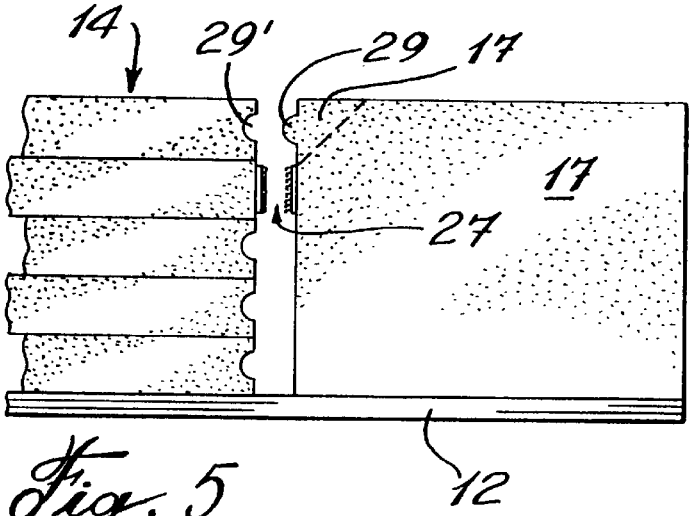
FIG. 5 is a partial side sectional view illustrating a variant embodiment in which protrusion and recess means are provided at an interface between the head and foot containment blocks and the pair of adjacent stacks of foam mattress elements.

As shown in FIG. 5, the invention provides a means for fastening the top and bottom edge surfaces of the stack of foam mattress elements 14 or 15 to the containment blocks 16 or 17. The object of the invention as shown in FIG. 5 is to improve surface continuity at the transition point between the stack of foam mattress elements 14 or 15 and the head or foot containment block. Shown in FIG. 5 at the top mattress element is a recess 29' fitting into a protrusion 29 at the top of the block 17. Alternatively, the top foam mattress element could be provided with a Velcro fastener as is illustrated at 27 (for the second mattress element).

As can be appreciated, at the interface between the blocks 16 and 17 and the stacks of foam mattress elements 14 and 15, it is possible to include modulator panels either in the blocks 16 or 17 or at the respective top and bottom portions of the mattress elements 14 and 15 so as to have the firmness of the mattresses 14 and 15 equalize with the blocks 16 and 17. Shown in FIG. 5 is a modulation panel zone 17' of medium hardness foam for the purposes of modulating firmness between the mattress stack 14 and the foot containment block 17. This modulation panel zone would follow the engaging edge surface of the block 17.

Figure 3:
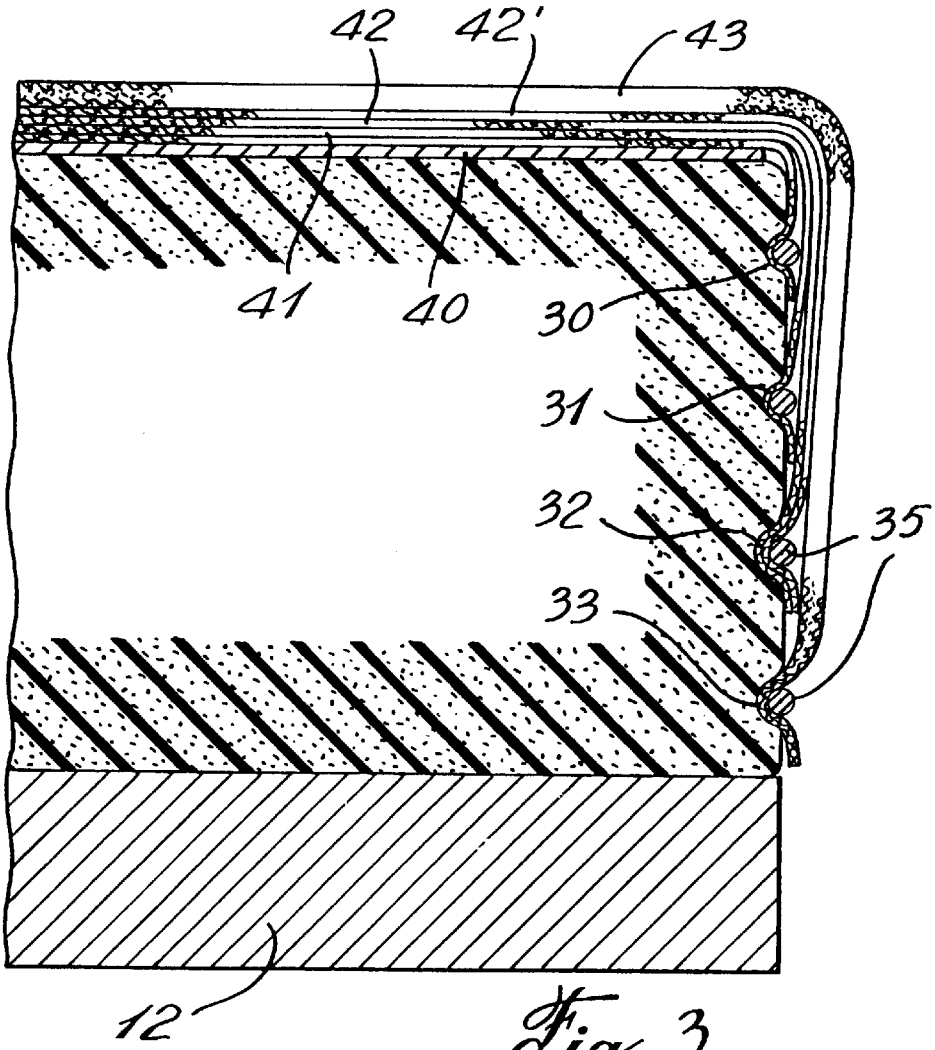
FIG. 3 is a sectional side view of the embodiment illustrated in FIG. 1 showing in detail the rope-receiving recess means for securing bedding.

As shown in FIG. 3, bedding according to the preferred embodiment is secured to the mattress assembly 10 by fastening the various elements of the bedding 40 through 43 into complementary recesses 30 through 33 using rope members 35. The recess grooves 30 through 33 in the preferred embodiment are provided in the containment blocks 16 and 17. Since the containment blocks are elastic, the ropes 35 need not be resilient since there will be resiliency in the containment blocks 17. It will be noted that using such ropes actually improves the containment ability of the mattress assembly 10. The bedding illustrated in FIG. 3 includes a mattress pad 40, a mattress cover 41, a bottom sheet 42 and a top sheet 42', and a blanket 43.

Preferably, the mattress pad 40 may include some texture to give the feel of ticking or the like. The mattress cover 41 may include the rope 35 within a hem of the cover 41 to reduce the chances of it slipping off and being removed from recess 31. While the sheets 42 and 42' are shown fastened into the same recess 32, it may be desirable to secure the bottom sheet 42 into recess 32 while the top sheet 42' is secured along with blanket 43 in recess 33. This may be desirable if the blanket and top sheet 42' are to be peeled back together while the bottom sheet 42 is always to remain securely fastened to the peripheral bedding anchor member.

In the embodiment shown in FIG. 1, the containment blocks 16 and 17 have upper lid portions 20 which can fold over the opposite side of the mattress to expose the mattress elements on one side. By removing the ropes 35, the head and foot lids 20 can be lifted and folded over to the other side with the bedding still covering them. Access to the stack of mattress elements 14 or 15 is then possible, and subsequently the bedding and lids 20 are folded back. The ropes 35 are placed back one at a time while the bedding is pulled taught.

As can also be appreciated the bedding receiving recesses 30–33 in the preferred embodiment are provided only in the containment block corners of the mattress assembly. If the retainer rope and recess system is used with a conventional mattress, the bedding anchor member can be an extra foam belt provided either all the way around the mattress or fastened just at the corners. The sheets 42 and 42', as well as the blanket 43 can be secured to the recess using the rope with a desired amount of slack or "blousé" (i.e. loose or billowy). The bedding can also be loose while remaining secured and closed in at the sides of the mattress by the rope 35 to prevent drafts, if desired.

I claim:

1. A foam mattress assembly comprising:

at least one stack of foam mattress elements arranged one on top of the other and having peripheral edges; and interface fastening means for fastening at least one of said peripheral edges of each one of said mattress elements together such that the stack of foam mattress elements remains in a vertical stack, wherein two said stacks are provided and arranged side by side with a lengthwise side of one of said stacks making contact with the other, said interface fastening means including means for fastening together one of a lengthwise lateral side edge of said mattress elements and a lengthwise edge horizontal border surface of said mattress elements.

2. The foam mattress assembly as claimed in claim 1, wherein a bottom one of said foam mattress elements in said stack is connected to a base of said foam mattress assembly.

3. The foam mattress assembly as claimed in claim 1, wherein said foam mattress elements of said two stacks include lengthwise edge modulator panels.

4. The foam mattress assembly as claimed in claim 1, wherein said interface fastening means include protrusion and dimple means provided on horizontal surfaces of said foam mattress elements at lengthwise ones of said peripheral edges.

5. A foam mattress assembly comprising:

at least one stack of foam mattress elements arranged one on top of the other and having peripheral edges;

interface fastening means for fastening at least one of said peripheral edges of each one of said mattress elements together such that the stack of foam mattress elements remains in a vertical stack; and separation means provided between said foam mattress elements to permit said foam mattress elements to flex and compress separately.

6. A mattress assembly comprising:

a base;

a pair of adjacent foam mattresses on said base;

a head containment block fastened to said base and extending across a top of said pair of adjacent foam mattresses; and a foot containment block fastened to said base and extending across a bottom of said pair of adjacent foam mattresses, said containment blocks including means for preventing a lateral outward movement of said mattresses on said base.

7. The mattress assembly as claimed in claim 6, wherein said blocks each comprise a two-part upper lid member and a bottom member, the upper lid member being hinged at a median line thereof on its upper surface for the purposes of being lifted from the side while pivoting about said median line, and said pair of adjacent foam mattresses comprising a vertical stack of foam mattress elements.

8. The mattress assembly as claimed in claim 7, wherein said blocks each comprise securing means connecting each of said two parts of said upper lid member to said bottom member.

9. The mattress assembly as claimed in claim 8, wherein said securing means comprise foam peg means for providing an interlocking vertically disposed peg member between said upper lid member and said bottom member.

10. The mattress assembly as claimed in claim 6, wherein said pair of adjacent foam mattresses each comprise a vertical stack of foam mattress elements.

11. The mattress assembly as claimed in claim 10, wherein said foam mattress elements include at a top and bottom portion thereof a tail portion, said containment blocks including recesses for receiving said tail portion, and further comprising means for securing said tail portions together so as to remain in a vertical stack and to said base.

12. The mattress assembly as claimed in claim 10, wherein at an interface between said blocks and said foam mattress elements, protrusion and recess means are provided to prevent the stacks of foam mattress elements from moving vertically independently of said containment blocks.

13. The mattress assembly as claimed in claim 10, further comprising modulator means provided at an interface between said stack of foam mattress elements and said containment blocks, said modulator means smoothing a compressibility transition between said containment blocks and said stack of foam mattress elements.

14. The mattress assembly as claimed in claim 10, wherein said stacks of foam mattress elements include separation means for permitting each of said mattress elements to compress and flex separately.

15. A mattress assembly comprising:

a mattress body providing a sleeping zone;

a peripheral bedding anchor member adapted to substantially surround an outer edge of the mattress body and including at least one peripheral bedding receiving recess means; and retainer means for securing bedding into said recess means, wherein said bedding is frictionally held in said recess means and is releasable from said recess means and said retainer means when pulled upwardly.

16. The mattress assembly as claimed in claim 15, wherein two said recess means are provided in said anchor member, an upper one of said recess means being provided for sheets, and a lower one of said recess means being provided for blankets.

17. The foam mattress assembly as claimed in claim 15, wherein four said recess means are provided, a first upper one for a mattress pad, a second one for a mattress cover, a third one for a sheet and a fourth lowest one for a blanket.

18. A mattress assembly comprising:

a mattress body providing a sleeping zone;

a peripheral bedding anchor member adapted to substantially surround an outer edge of the mattress body and including at least one peripheral bedding receiving recess means; and retainer means for securing bedding into said recess means, wherein said recess means are provided in corners only of said anchor member.

19. A mattress assembly comprising:

a mattress body providing a sleeping zone;

a peripheral bedding anchor member adapted to substantially surround an outer edge of the mattress body and including at least one peripheral bedding receiving recess means; and retainer means for securing bedding into said recess means, wherein said mattress body comprises a multilayer foam mattress system, and said anchor member serves as a containment means for said mattress system.

20. The mattress assembly as claimed in claim 19, wherein said mattress system comprises a pair of side-by-side vertical stacks of foam mattress elements.

21. The mattress assembly as claimed in claim 20, wherein said foam mattress elements are provided with separation means for permitting said foam mattress elements to flex and compress separately.

22. The mattress assembly as claimed in claim 20, wherein said anchor member is made of foam, and said foam mattress elements include modulator panels at least at a lateral interface between said mattress elements and said anchor member so as to provide a smoother transition in mattress compression between said mattress body and said anchor member at least at sides thereof.

23. A mattress assembly comprising:

a mattress body providing a sleeping zone;

a peripheral bedding anchor member adapted to substantially surround an outer edge of the mattress body and including at least one peripheral bedding receiving recess means; and retainer means for securing bedding into said recess means, wherein said interface fastening means comprise hook and loop type fasteners between horizontal lengthwise edge border surfaces of said foam mattress elements.

24. The mattress assembly as claimed in claim 23, wherein said hook and loop fasteners are provided at discrete locations so as to provide vertical fastening lines at least at a head, middle and foot portion of said lengthwise edges.

* * * * *